United States Patent [19]

O'Neil

[11] 4,228,641

[45] Oct. 21, 1980

[54] THERMOPLASTIC TWINES

[75] Inventor: John B. O'Neil, Summerville, S.C.

[73] Assignee: Exxon Research & Engineering Co., Florham Park, N.J.

[21] Appl. No.: 946,888

[22] Filed: Sep. 28, 1978

[51] Int. Cl.[3] ..... D02G 3/36

[52] U.S. Cl. ..... 57/234; 57/210; 57/7

[58] Field of Search ..... 57/210, 216, 220, 222, 57/234, 7, 12, 907; 156/180, 167, 148; 264/103, 167, 174

[56] References Cited

U.S. PATENT DOCUMENTS

| | | | |
|---|---|---|---|
| 2,050,564 | 8/1936 | Dodge | 57/220 |
| 2,281,647 | 5/1942 | Whitehead | 57/234 X |
| 2,953,418 | 9/1960 | Runton et al. | 57/234 X |
| 3,315,455 | 4/1967 | Stoller | 57/907 X |
| 3,332,228 | 7/1967 | Chill | 57/907 X |
| 3,415,919 | 12/1968 | Kippan | 264/167 |
| 3,446,002 | 5/1969 | Keppain | 57/234 |
| 4,095,403 | 6/1978 | Berand et al. | 57/234 X |

*Primary Examiner*—John Petrakes

*Attorney, Agent, or Firm*—M. B. Kurtzman; J. J. Mahon

[57] ABSTRACT

A twine comprised of a core bundle of synthetic monofilaments twisted along the length of the twine and a synthetic binder material in thin band form spirally wound about the monofilaments in a direction opposite to the core bundle twist has been found to form knots of superior strength which are less susceptible to slippage while maintaining good flexibility. A further embodiment comprises the bundle of twisted monofilaments and a synthetic binder in thin band form spirally wound in the direction of the core bundle twist so as to provide a flat twine useful as cable filler.

17 Claims, 3 Drawing Figures

THERMOPLASTIC TWINES

BACKGROUND OF THE INVENTION

1. Field of the Invention

This invention relates to synthetic monofilament twines. More particularly, this invention relates to synthetic monofilament twines produced from a bundle of orientated thermoplastic monofilaments which are twisted along the length of the twine and which are bound by a thermoplastic material which extends around the bundle in a spiral form.

2. Prior Art

U.S. Pat. No. 2,552,210 to W. B. Parker discloses a ply yarn comprising a bundle of natural fibers entwined together with a fine filament nylon yarn. The ply yarn has a twist imparted to it.

U.S. Pat. No. 3,315,454 to Enerza discloses a synthetic twine suitable for forming knots in baling, tying and other automatic knot tying machines. The twine comprises a plurality of filaments of a thermoplastic resin and containing dispersed therein a gas so as to produce foamed filaments.

U.S. Pat. No. 3,446,002 to Kippan discloses a twine comprised of a bundle of substantially parallel synthetic monofilaments with a synthetic binder material in thin band form wrapped around and fused to the outer monofilaments.

U.S. Pat. No. 3,577,873 discloses a core yarn comprising a core component of set false twisted synthetic continuous multifilaments and at least one wrapping component of synthetic continuous filaments formed in helices around the core components, the direction of the helices being reversed at intervals along the yarn.

U.S. Pat. No. 3,769,787 to Rosenstein et al discloses a multiple filament yarn of a synthetic textile useful for knitting, winding and weaving which multi-filament textile yarn has continuously disposed thereabout two special wrapper filaments wrapped in a generally helical path about the core filaments of the yarn, one wrapper being disposed in a clockwise manner and the other wrapper being disposed in a counterclockwise manner.

U.S. Pat. No. 3,851,457 to Waters discloses a core yarn comprised of a set false twisted core and a wrapper of filaments formed in reversing helices.

Kippan in U.S. Pat. No. 3,415,919 notes several disadvantages of the twisted twine. The primary disadvantage is a weaker twine, since the helices are able to assume only a portion of an applied tensile load, whereas in a parallel alignment of monofilaments as disclosed in his patent, each filament is able to fully bear an applied tensile load. In theory, at least the tensile strength of a twine having all of the monofilaments aligned is the sum of the tensile strength of each filament (in practice tensile strength is slightly less).

It has been found nevertheless that the twine or cord such as described by Kippan having parallel monofilaments bound by an extruded binder presents certain disadvantages when employed in mechanical balers. The straight monofilaments can be deformed in a knotting operation such that the individual fibers break out between the spiral binding. The structure becomes less homogeneous in the knotting step and a protruding monofilament may catch in the mechanism. Furthermore, the tensile strength of the twine involved in the knot is considerably reduced over the tensile strength of the linear twine.

SUMMARY OF THE INVENTION

It is an object of the present invention to provide synthetic monofilament twines which have superior knotting characteristics as compared with the synthetic twines heretofore known.

It is a further object of the invention to provide twines having consistent characteristics throughout the length thereof and which are rot resistant and resistant to ultraviolet radiation. It is a further object of the invention to provide a synthetic twine having monofilaments twisted with respect to each other along the length of the twine, a means for retaining the monofilaments and their twisted relationship to each other without interfering in the flexibility of the twine.

Accordingly, there is provided a twine comprising a core bundle of continuous synthetic orientated monofilaments extending lengthwise and twisted so as to contain from 0.3 to about 3.0 turns per linear inch of monofilament twine and a synthetic binder in thin band form made from a material compatible with the monofilament material and spirally wound in a direction reversed to the core bundle twist so as to contain from about 8 to 30 spirals per linear foot of the twisted monofilaments, the spirally wound band being adhered to the monofilaments along the length of the twisted core bundle.

The twist imparted into the core bundle of monofilaments generally is of the false twist type. A "false twist" as the term is generally used and understood herein is a twist which is applied to a filament or a bundle of filaments by a torque applied thereto, which will reverse and return to the zero twist upon release of the torque. In accordance with a preferred embodiment of this invention, it has been found that imparting a false twist to a bundle of thermoplastic monofilaments and thereafter extruding a band or a binder about the bundle, in a direction opposite to the twist, provides a more homogeneous structure in the sense that the twine has consistent characteristics throughout its length and additionally that the yarn has improved knot strength over yarns made from, for example, parallel monofilaments spirally encapsulated.

In accordance with another embodiment of this invention, there is provided a flat twine useful as a cable filler and comprising a twisted core bundle of from 40 to 240 synthetic monofilaments extending lengthwise of the twine and a synthetic binder in band form made from a material compatible with the monofilament material and spirally wound in the direction of the core bundle twist.

DETAILED DESCRIPTION OF THE PREFERRED EMBODIMENTS

Figure 1:
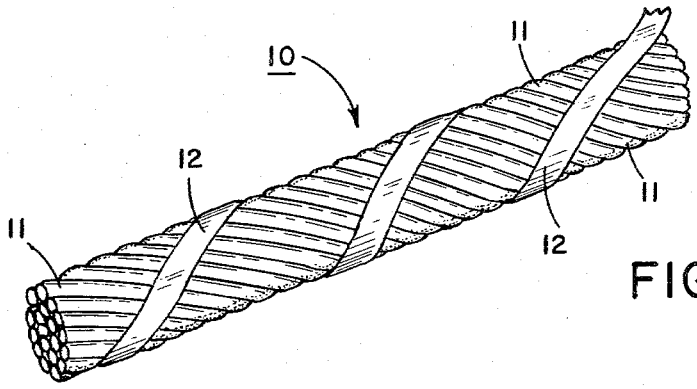
FIG. 1 is an enlarged view of a segment of the twine of this invention.

Referring to the drawings, FIG. 1 illustrates a segment of twine 10 made in accordance with the present invention. The twine is made up of a core bundle of continuous orientated synthetic monofilaments 11 extending lengthwise and having imparted therein a right twist (Z twist). A synthetic binder 12 compatible with the monofilaments extends spirally about the monofilaments 11 and is fused to the outer filaments of the core bundle with which the spirally wound band comes into contact. As illustrated, the spiral band 12 is wrapped about the twisted core bundle in a direction opposite to the twist of the core bundle which is in the left direction (S twist).

The twist direction of the core bundle and the direction of the spiral wrap of the band material in accordance with this embodiment of the invention must be in opposite direction. However, the particular direction of the twist or wrap does not constitute the essence of the invention. For example, the core bundle can be twisted in the S direction while the band is wrapped in the Z direction. On the other hand, as illustrated in FIG. 1, the core bundle can be twisted in the Z direction while the band is wrapped spirally in the S direction.

The spiral windings are formed in such a manner as to leave gaps between the windings such that some of the monofilaments are exposed. Because the binder, or spiral band, is fused to each of the outer monofilaments over a comparatively large contact area the binder material cannot be shifted longitudinally along the twine.

Figure 2:
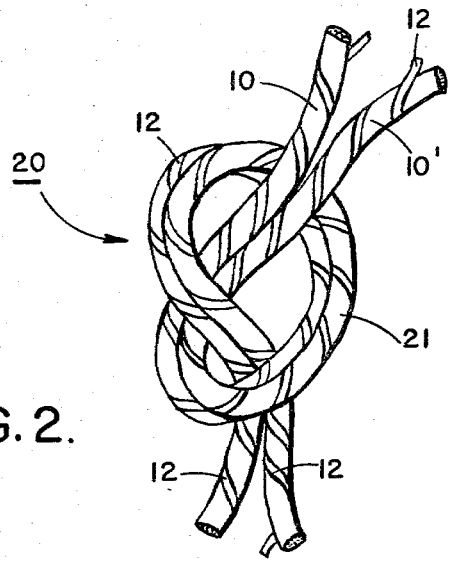
FIG. 2 is an illustration of a simple knot made with the twine of this invention.

Referring now to FIG. 2 there is illustrated knot 20 formed from the twine as illustrated in FIG. 1. When two pieces of twine 10 and 10' are tied into knot 20 there is, as compared with prior art twine comprising parallel monofilaments, an increase of resistance to the slipping or untying of the knot by the twisted monofilaments. This twist resistance also prevents further deformation of the spiral band area 12. Furthermore, as a result of the presence of the twist imparted to the monofilaments there is a substantial absence of any looping filaments. Looping in the prior art synthetic twines consisting of parallel monofilaments can result in knot breakage. The looping is a result of the distortion of the parallel monofilaments as the twine goes through the knotting mechanism. As a result of such distortion loose filaments stick out and can catch on hooks, for example, that may be present in a baling system. Furthermore, as a result of the distortion developed in the knot area of twine the structure for twine comprising parallel monofilaments becomes less homogeneous whereas the twisted twine in its resistance to distortion maintains homogeneity along its length.

The monofilaments 11 of the twine 10 are preferably made from synthetic resins. More particularly, the monofilaments employed in accordance with this invention are preferably prepared from synthetic thermoplastic resins and preferably polyolefins, such as, for example, polypropylene, polyethylene and preferably high density polyethylene, and copolymers of ethylene and propylene. Also included are other resin types, polyamides, polyesters, polycarbonates, polyvinyls. The binder band 12 must be formed of a material that is compatible with the monofilament material such that they both react to heat in substantially the same manner. Hence, the spiral binders are prepared from thermoplastic resins or thermoplastic rubbers, such as, for example, polypropylene, polyethylene, polyamide, polyesters, polycarbonates, polyvinyl types, copolymers of ethylene and propylene and ethylene-propylene rubbers. Especially preferred are blends of ethylene-propylene rubber with polypropylene modified with oil and carbon black and sold under the trademark VISTAFLEX® by Exxon Chemical Company. Another preferred rubber is a block copolymer comprising polystyrene end blocks with polyolefin rubbers as the midblock such as KRATON® produced by Shell Chemical Company.

The monofilaments 11 of twine 10 and spiral bands 12 can be formed of the same material or they can be formed from different materials so long as the spiral band and the monofilaments are compatible with each other. The compatibility is particularly necessary when the binder is wound around the monofilaments at the fusing temperature such that the wrap and monofilaments can readily fuse.

The number of continuous monofilaments employed in the twine can be from about 40 to about 340 and preferably from about 95 to 195 monofilaments per twine bundle. Most preferably, the twine bundle comprises about 130 continuous monofilaments. The monofilaments are generally wound about with one continuous spiral band.

The monofilaments are uniformly twisted at a rate of about 0.3 to 3.0 turns per linear inch of twine and preferably from about 0.5 to about 1.5 turns per linear inch of twine. The binder band will be wound at the rate of approximately 8 to 30 spirals per linear foot of twine and preferably about 10 to about 16 spirals per linear foot of twine. Necessarily, the twist is imparted to the monofilaments prior to fusing the wrap to the monofilaments.

The denier of the twine can be from about 5,000 to about 50,000 and most preferably from about 20,000 to about 40,000. Each monofilament will have a denier of about 50 to about 1,000 and preferably about 200 denier.

The binder band should be quite thin so as to not interfere with the flexibility of the twine. The best results obtained have been when the denier of the spiral band is about 10% to about 25% of the total twine denier and most preferably about 15% of the total twine denier.

The method of producing the synthetic twine of this invention comprises imparting a twist to a continuous bundle of orientated synthetic monofilaments extending longitudinally to each other and thereafter applying the thin synthetic binder band made of material compatible with the monofilaments and which is hot enough to fuse slightly with the outer monofilaments with which the band material comes into contact. The binder band material must be such that it will fuse to the outer monofilaments to a slight depth. In accordance with a preferred aspect of this invention the process for preparing the synthetic twine comprises imparting a false twist to a bundle of orientated synthetic monofilaments which prior to imparting the twist extend longitudinally substantially parallel to each other. As mentioned above, it is desirable to impart about 0.3 to about 3.0 turns per linear inch of monofilament bundle. After imparting the false twist and before the false twist has an opportunity to untwist, i.e., to come back out again. The spiral is applied to the twisted monofilaments so as to adhere to the outermost filament layer. The spiral is applied in a direction opposite to the monofilament twist so as to provide about 8 to 30 spirals per linear foot of twisted monofilaments. In co-pending application Ser. No. 946,889, filed Sept. 28, 1978 for METHOD AND APPARATUS FOR MAKING MONOFILAMENT TWINES there is disclosed a process which comprises continuously drawing a bundle of substantially parallel monofilaments along a path, imparting a false twist to the bundle of said parallel monofilaments and directing a stream of molten synthetic material onto the outer surface of the moving, twisted monofilament bundle to form a spiral band therearound. The apparatus generally comprises an extruder for extruding the monofilaments, a means for directing a continuous stream of molten synthetic material to form the band onto the outer monofilaments of the twisted moving bundle and false twisting means for imparting a false twist to said bundle of monofilaments. The twisting means is located at a point prior to the directing means.

Referring to Table I, it is shown that the knot strength and the general tying performance of the twisted twine is superior to that of conventional synthetic twine comprising parallel monofilaments.

TABLE I

| Twine wt. lbs/10K' | Monofilaments per twine | Twist Present | Tying Performance | | | | |
|---|---|---|---|---|---|---|---|
| | | | Bales Tied | Knots Tied | Knots Missed | Knot Failure | Knot Strength (lbs.) |
| 30.1 | 160 | Yes | 137 | 411 | 1 | 0.2% | 201 |
| 29.3 | 160 | No | 120 | 360 | 6 | 1.7% | 193 |
| 18.0 | 96 | Yes | 189 | 378 | 4 | 1.1% | 116 |
| 17.8 | 96 | No | 180 | 360 | 6 | 1.7% | 106 |

In accordance with an aspect of this invention the monofilaments and band material can be foamed by dispersion of gas through the filaments at about 16 to about 66% by volume based on the volume of the resin and more preferably, at about 32% by volume based on the volume of the resin. The spiral band can be foamed alone or both the monofilaments and the spiral band can be foamed. Processes for the foaming resin are well known to those of ordinary skill in the art and such processes are disclosed in, for example, U.S. Pat. No. 3,214,234 of Bottomley and U.S. Pat. No. 3,315,454 of Carranza each of whose disclosures are incorporated by reference.

Figure 3:
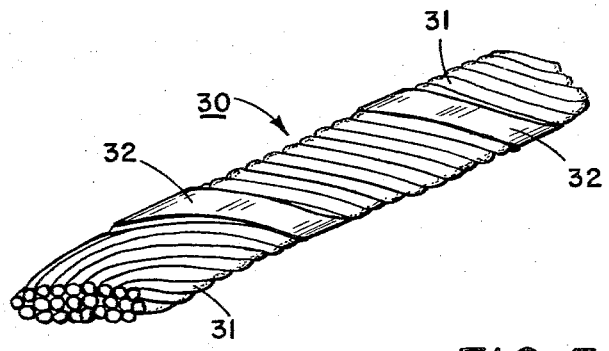
FIG. 3 is an enlarged view of a segment of twine in accordance with another embodiment of this invention.

In accordance with another aspect of this invention there is provided an extremely flat continuous twine which can be usefully employed as cable filler, i.e., to fill in the spaces between the wires bound in cable. In accordance with this aspect of the invention the band material is formed as a spiral which is in substantially the same direction as the twist of the monofilaments. In referring to FIG. 3 there is shown the flat twine 30 comprising a monofilament twisted in an S direction and spirally wound about spiral band 32 which is wound in the same direction as the monofilaments, i.e., an S spiral. As illustrated in FIG. 3 the twine is extremely flat. Although the twine as illustrated in FIG. 3 comprises S twisted monofilaments and S wound spiral wrap the monofilaments and spiral wrap can be in the Z direction.

Suitable stabilizer or pigments can be added to the resins which form the monofilaments and binder in order to protect them against ultraviolet degradation. Furthermore suitable fillers and blowing agents may be added to the resins for monofilament and binder in order to change the density or bulkiness property.

The term "monofilament" as used in the specification and the following claims are intended to include monofilaments of any desired cross section. The binder bands also can be of any desired cross section, although it is preferable to use bands of rectangular or oval cross section.

It is claimed:

1. A twine comprising a core bundle of continuous synthetic oriented monofilaments extending lengthwise of the twine and twisted so as to contain from 0.3 to about 3.0 turns per linear inch of monofilament twine and a synthetic binder in thin band form made from a material compatible with the monofilaments material, spirally wound in a direction reverse to the core bundle twist, and containing from about 8 to 30 spirals per linear foot of twisted monofilaments, the spirally wound band being adhered to the outer monofilaments along the length of the twisted core bundle.

2. The twine of claim 1 wherein the core bundle contains from 40 to 340 monofilaments.

3. The twine of claim 2 wherein the core bundle contains from 95 to 195 monofilaments.

4. The twine of claim 1 wherein the core bundle of monofilaments is spirally encapsulated while in a false twisted condition.

5. The twine of claim 1 or 4 wherein said core filaments are twisted so as to contain from about 0.5 to 1.5 turns per linear inch of monofilament twine.

6. The twine of claim 5 wherein said core filament contains about 6 turns per linear foot of monofilaments and said spiral band contains about 10 to about 16 spirals per linear foot of monofilaments.

7. The twine of claim 1 wherein the synthetic monofilaments and spiral binder are thermoplastic resins, including polyolefins, polyamides, polyesters, polycarbonates and polyvinyl types.

8. The twine of claim 7 wherein the thermoplastic resins are polyolefins and the binder one of thermoplastic polyolefin resins or thermoplastic rubber.

9. The twine of claim 8 wherein the polyolefins are selected from the group consisting of polypropylene, polyethylene and copolymers of ethylene and propylene.

10. The twine according to claim 7 wherein the monofilaments and spiral binder are polypropylene.

11. The twine of claim 1 wherein said monofilaments have a denier of about 50 to 1000 and the twine is in the range of about 5000 to 50,000 denier and the denier of the spiral band is in the range of 10% to 25% of the denier of the total twine denier.

12. The twine of claim 11 wherein said twine is in the range of about 20,000 to 40,000 denier, said monofilaments are about 200 denier and the denier of the spiral band is about 15% of the total twine denier.

13. The twine of claim 1 wherein the spiral band is foamed.

14. The twine of claim 13 wherein the spiral band contains a gas dispersed therein at about 16 to about 66% of volume based on the volume of the resin.

15. The twine of claim 1 wherein the monofilaments and spiral band are foamed.

16. The twine of claim 15 wherein the monofilaments and band contain a gas dispersed therein at about 16 to about 66% by volume based on the volume of the resin.

17. The twine of claim 13 or 15 wherein the gas is present at about 32% by volume based on the volume of the resin.

* * * * *